United States Patent [19]

Werber

[11] 4,283,856

[45] Aug. 18, 1981

[54] GARMENT DESIGNING AID

[76] Inventor: Fred W. K. R. Werber, 29 Schaumans-kamp, Reinbeck, Hamburg, Fed. Rep. of Germany

[21] Appl. No.: 16,668

[22] Filed: Mar. 1, 1979

Related U.S. Application Data

[62] Division of Ser. No. 853,668, Nov. 21, 1977, Pat. No. 4,156,969.

[30] Foreign Application Priority Data

Nov. 19, 1976 [GB] United Kingdom ..... 48456/76
Mar. 9, 1977 [ZA] South Africa ..... 77/1434

[51] Int. Cl.[3] ..... A41H 3/015
[52] U.S. Cl. ..... 33/14
[58] Field of Search ..... 33/14–17

[56] References Cited

U.S. PATENT DOCUMENTS

| | | | |
|---|---|---|---|
| 740,172 | 9/1903 | Parker et al. | 33/14 |
| 882,111 | 3/1908 | Horeischi | 33/14 |
| 931,896 | 8/1909 | Terry | 33/14 |
| 943,130 | 12/1909 | Webster | 33/14 |
| 1,114,468 | 8/1915 | Russell | 33/14 |
| 1,260,849 | 3/1918 | Zech | 33/14 |

FOREIGN PATENT DOCUMENTS

| | | | |
|---|---|---|---|
| 270818 | 7/1930 | Italy | 33/14 |
| 13372 | of 1913 | United Kingdom | 33/14 |

*Primary Examiner*—Charles E. Phillips
*Attorney, Agent, or Firm*—Ladas & Parry

[57] ABSTRACT

There is provided a skirt design aid which has four template panels that are slidably secured together to be pivotally and/or linearly relatively displaceable, so as to cater for different sizes and skirt styles. This skirt aid also has two pivoted members for varying hip sizes.

4 Claims, 1 Drawing Figure

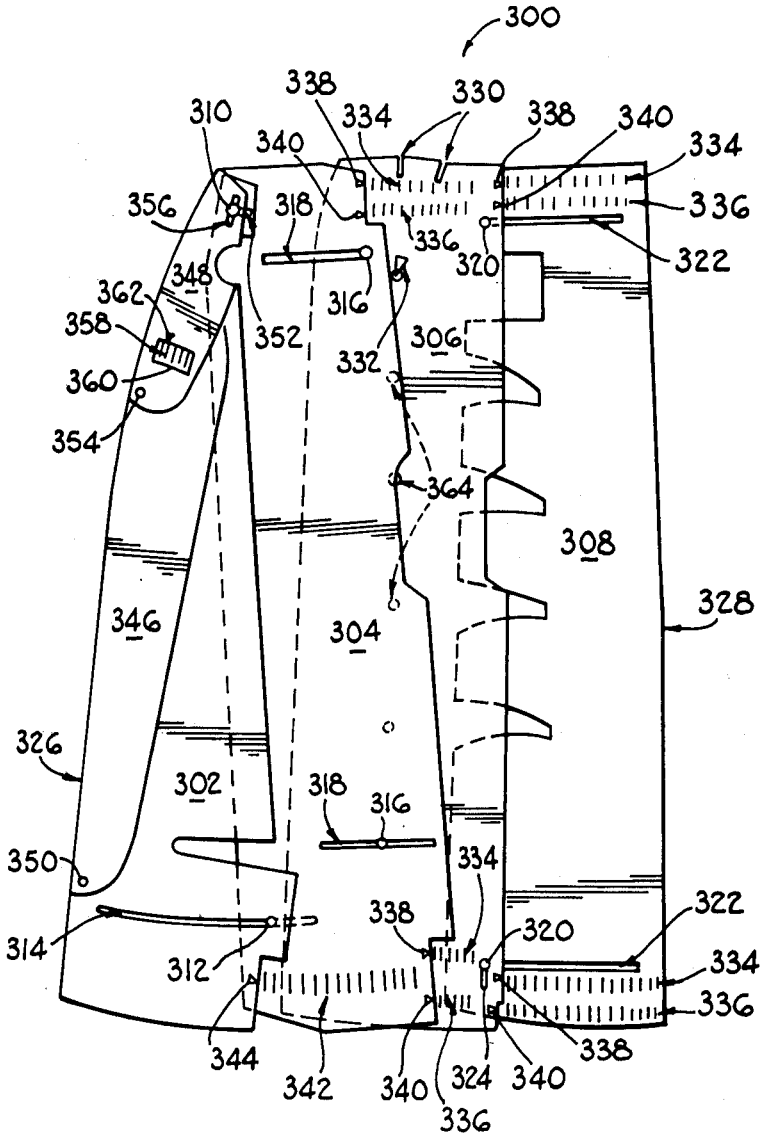
300
338
330
310
334
338
340
340
334
356
318
336
336
320
322
348
316
362
352
358
306
332
360
354
364
308
346
304
328
326
302
318
316
350
334
338
322
314
320
312
334
336
344
342
340
324
340
338
336

GARMENT DESIGNING AID

This is a divisional of co-pending Application Ser. No. 853,668 filed Nov. 21, 1977, now U.S. Pat. No. 4,156,969 granted June 5, 1979.

This invention relates to a pattern designing aid. More particularly, the invention relates to an aid for assisting a person in designing skirts.

Conventionally, women who do their own sewing and are unable to design clothing rely on purchased patterns for making dresses. These patterns come in fixed sizes predetermined by statistics and do not cater for in-between sizes and items such as differences in bust, waist, neck and arm measurements.

There is, of course, also a system by means of which small patterns may be enlarged to given sizes by a special kit. This system does not always suit all dressmakers since it calls for the drawing of the pattern from a series of dots.

Garments such as bodices, pants and skirts normally can be considered to consist of four panels which when joined together from the bodice, pants or skirt as the case may be. For example, with a bodice, when the four panels are joined together, they form the back and front of the bodice with arm-holes, a neck opening and a waist opening. It will be appreciated that the panels are in pairs—a front pair and a back pair. Each panel of a pair is a mirror image of the other panel of that pair. For a given garment, one thus need essentially a pattern for one front panel and a pattern for one back panel. Thereafter, the panels can be cut as mirror images of the ready cut panels.

According to the invention, there is provided a skirt design aid for assisting a person in providing a pattern for a skirt, the design including four template sections that are interconnected and are relatively displaceable as follows:

a first substantially triangular template section, its apex being located at the waist side of the pattern;

a second substantially rectangular template section, the first template section being pivotally secured at its apex to an upper corner portion of the second template section, and with the degree of pivotal overlap of the first and second template sections being adjustable;

a third template section that is also substantially rectangular that is secured to the second template section in a linear sliding manner; and a fourth template section that is also substantially rectangular and is secured to the third template section in a linear sliding manner.

The fourth template section may be secured to the third template section so that they are both pivotally and linearly relatively displaceable.

The skirt designing aid may have a hip adjusting means. Thus, a first hip adjusting member may be pivotally attached at one end to either the first or the fourth template section. A second hip adjusting member may be pivotally attached at one end to the first member intermediate the first member's end. The free ends of the first and the second members may then be secured to the first or the fourth template sections respectively.

The third template section may also have at its upper end a dart defining means. This may be effected by means of notches and apertures, or by other suitable markings on the third template section.

Some or all of the first, second, third and fourth template sections may have pointers by means of which design features may be incorporated in the pattern, these pointers being in the form of numerals provided on peripheral portions of the first, second, third or fourth template sections.

The skirt design aid may also include a size indicating means in the form of suitable markings on the template sections, for indicating the manner and extent to which the template sections must be displaced relative to one another to provide the required size and design of skirt. The template sections may be of a suitable sheet material. Preferably they are of a suitable synthetic plastics material although they may also be of a cardboard or similar material.

The invention will now be described, by way of example, with reference to the accompanying drawing which shows a skirt design aid in accordance with the invention.

A skirt design aid is now described with reference to the drawing, the design aid being indicated by reference numeral 300. The skirt design aid 300 comprises four template sections, a first template section 302 a second template section 304, a third template section 306 and a fourth template section 308. The first template section 302 is substantially triangular in shape, and the other three template sections 304, 306 and 308 are substantially rectangular. The first template section 302 is pivotally attached at its upper apex end to the top left-hand corner of the second template section 304 by means of a pivot pin 310. The pivot pin 310 is in the form of a nut and bolt arrangement, the purpose of which will be explained below. The position of the first template section 302 relative to the second template section 304 may be varied by means of a further nut and bolt arrangement 312, the bolt being fast with the second template section 304 and being slidable in a slot 314 in the first template section 302. The third template section 306 is slidably attached to the second template section 304 in an adjustable manner, by means of nut and bolt arrangements 316 and slots 318 provided in the second template section 304. Similarly, the fourth template section 308 is slidably secured to the third template section 306 to be both linearly and pivotally displaceable, by means of nut and bolt arrangements 320 suitable slots 322 being provided in the fourth template section 308 and a slot 324 being provided in the third template section 306. The outer edges 326 and 328 of the first and fourth template sections 302 and 308 respectively define the sides of skirt panels which are utilised to form the skirt. The upper ends of the template sections define the top edge of the panels, and the bottom ends of the template sections define the bottom edge of the skirt panels. At its upper end, the third template section 306 has two notches 330 and a triangular aperture 332 which define a waist dart. On the third template section 306 and on the fourth template section 308, are provided two sets of gradations, 334 and 336, both at the top and at the bottom of the template sections. Appropriate pointers 338 and 340 are provided on the second and third template sections 304 and 306 to reference the gradations 334 and 336. A further set of gradations 342 is marked on the bottom portion of the second template section 304, these gradations being referenced by a pointer 344 provided on the first template section 302.

The skirt design aid also has a hip adjusting means, in the form of two members 346 and 348. The member 346 is pivotally attached at its bottom end to the first template section 302 towards its bottom end by a pivot pin 350. At its upper end, the member 346 has a slot 352 which is engaged by the nut and bolt arrangement 310. The member 348 is pivotally attached at its bottom end to the member 346 in the hip region of the skirt, by a pivot pin 354. This member 348 also has a slot 356 which is engaged by the nut and bolt arrangement 310. It will be appreciated that by pivoting the member 346, the member 348 is also displaced, thereby altering the outline of the outer edge 326 and thereby increasing the hip size of the pattern. The extent to which the hip size is increased is indicated by a set of gradations 358 marked on the member 346 which is visible through a window 360 in the member 348 and which are referenced by means of a pointer 362. The nut and bolt arrangement 310 is utilised to release the members 346 and 348 so that they may be adjusted and then secured in the required configuration. A number of apertures 364 is provided in the third template section 306 by means of which styling changes may be effected.

In use, the relative positions of the second and fourth template sections 304 and 308 with respect to the third template section 306 are varied in accordance with the size required, the required size being indicated by the gradations 334 and 336. The gradations 334 are the appropriate gradations if the pattern is to have a dart (utilising the notches 330 and the aperture 332), and the gradations 336 are utilised if the pattern does not have a dart. If the skirt is to be flared, the first template section 302 is pivoted with respect to the second template section 304, the required amount. If a large amount of flaring is required, the fourth template section 308 is also pivoted, the nut and bolt arrangement 320 then sliding in the slot 324. Further, if the skirt is to have pleats, whether of the knife or box type, the fourth template section 308 is accordingly extended.

In use, the skirt design aid 300 is extended as required, in accordance with the size and type of skirt desired, then placed on a sheet of paper and its outline drawn on the paper.

I claim:

1. A skirt design aid for assisting a person in providing a pattern for a skirt, the design aid including four template sections that are interconnected and are relatively displaceable as follows:

a first substantially triangular template section, whose apex is located at the waist side of the pattern and which extends the length of the pattern so that its base is located at the hem line of the pattern;

a second substantially rectangular template section, an upper portion of which defines part of the waist of the pattern, and which extends to the hem line of the pattern, the first template section being pivotally secured at its apex to an upper corner portion of the second template section, and with the degree of pivotal overlap of the first and second template sections being adjustable;

a third template section that is also substantially rectangular, which also extends from the waist line to the hem line and is secured to the second template section on the opposite side thereof to the first template section in a linear sliding manner;

a fourth template section that is also substantially rectangular and which also extends from the waist line to the hem line and which is secured to the third template section on the opposite side thereof to the second template section in a linear sliding manner; and a hip dimension varying means which comprises a first member pivotally attached at one end to the first template section and a second member pivotally attached at one end to the first member intermediate the first member's ends, with the free ends of the first and second members being secured to the first template section by means of a screw and nut, the screw passing through suitable slots in the first and second members.

2. A skirt design aid as claimed in claim 1, in which the fourth template section is secured to the third template section so that they are both pivotally and linearly relatively displaceable.

3. A skirt design aid as claimed in claim 1, in which the third template section has at its upper end a dart defining means.

4. A skirt design aid as claimed in claim 1, in which size indicating markings are provided on the third template section by means of which the second and third template sections are relatively adjustable and further size indicating markings are provided on the fourth template section by means of which the third and fourth template sections are relatively adjusted.

* * * * *